US010041369B2

(12) United States Patent
Blaney et al.

(10) Patent No.: US 10,041,369 B2
(45) Date of Patent: Aug. 7, 2018

(54) BOAS WITH RADIAL LOAD FEATURE

(71) Applicant: UNITED TECHNOLOGIES CORPORATION, Hartford, CT (US)

(72) Inventors: Ken F. Blaney, Middleton, NH (US); Brian R. Pelletier, Berwick, ME (US); James N. Knapp, Sanford, ME (US)

(73) Assignee: UNITED TECHNOLOGIES CORPORATION, Hartford, CT (US)

( * ) Notice: Subject to any disclaimer, the term of this patent is extended or adjusted under 35 U.S.C. 154(b) by 335 days.

(21) Appl. No.: 14/910,899

(22) PCT Filed: Aug. 5, 2014

(86) PCT No.: PCT/US2014/049752
§ 371 (c)(1),
(2) Date: Feb. 8, 2016

(87) PCT Pub. No.: WO2015/021029
PCT Pub. Date: Feb. 12, 2015

(65) Prior Publication Data

US 2016/0194974 A1 Jul. 7, 2016

Related U.S. Application Data

(60) Provisional application No. 61/862,544, filed on Aug. 6, 2013.

(51) Int. Cl.

| | |
|---|---|
| ***F01D 11/08*** | (2006.01) |
| ***F01D 11/24*** | (2006.01) |
| ***F01D 25/24*** | (2006.01) |
| ***F04D 29/16*** | (2006.01) |
| ***F01D 25/28*** | (2006.01) |
| ***F01D 21/04*** | (2006.01) |

(52) U.S. Cl.
CPC ..... *F01D 11/08* (2013.01); *F01D 11/24* (2013.01); *F01D 21/045* (2013.01); *F01D 25/246* (2013.01); *F01D 25/28* (2013.01); *F04D 29/164* (2013.01); *F05D 2220/32* (2013.01); *F05D 2240/11* (2013.01)

(58) Field of Classification Search
CPC ..... F01D 11/08; F01D 25/28; F05D 2240/11
See application file for complete search history.

(56) References Cited

U.S. PATENT DOCUMENTS 5,092,735 A 3/1992 Katy et al.
5,762,472 A * 6/1998 Pizzi ..... F01D 11/005 415/135

(Continued)

FOREIGN PATENT DOCUMENTS

DE 69410820 T2 2/1999

OTHER PUBLICATIONS

The International Preliminary Report on Patentability for PCT Application No. PCT/US2014/049752, dated Feb. 8, 2016.

*Primary Examiner* — Ninh H Nguyen
(74) *Attorney, Agent, or Firm* — Carlson, Gaskey & Olds, P.C.

(57) ABSTRACT

This disclosure relates to a gas turbine engine including a blade outer air seal (BOAS) having at least one attachment hook adjacent one of a leading edge and a trailing edge thereof. The BOAS further includes at least one radial standoff axially aligned with the at least one attachment hook.

14 Claims, 6 Drawing Sheets

(56) References Cited

U.S. PATENT DOCUMENTS

| | | | | |
|---|---|---|---|---|
| 6,910,854 | B2 * | 6/2005 | Joslin | F01D 5/225 415/139 |
| 7,374,395 | B2 * | 5/2008 | Durocher | F01D 9/04 415/115 |
| 7,686,068 | B2 | 3/2010 | Tholen et al. | |
| 8,066,052 | B2 | 11/2011 | Blair | |
| 8,122,583 | B2 | 2/2012 | Luczak et al. | |
| 8,439,629 | B2 | 5/2013 | Pietraszkiewicz et al. | |
| 8,439,639 | B2 | 5/2013 | Joe et al. | |
| 8,876,458 | B2 * | 11/2014 | Thibodeau | F01D 11/08 415/1 |
| 9,079,245 | B2 * | 7/2015 | Durocher | F01D 9/02 |
| 2013/0071227 | A1 | 3/2013 | Thibodeau | |

* cited by examiner

BOAS WITH RADIAL LOAD FEATURE

GOVERNMENT CONTRACT

This invention was made with government support under Contract No. N68335-13-C-0005 awarded by the United States Navy. The government has certain rights in this invention.

BACKGROUND

Gas turbine engines include turbine blades configured to rotate and extract energy from hot combustion gases that are communicated through the gas turbine engine. An outer casing of an engine static structure of the gas turbine engine may include one or more blade outer air seals (BOAS) that provide an outer radial flow path boundary for the hot combustion gases.

BOAS are known to include attachment hooks projecting radially outward therefrom for attachment to an engine static structure. The primary purpose of these hooks is to support the BOAS relative to the rotor blades. However, the hooks also function to transfer a load created during a blade out condition. In a blade out condition, one or more blades become at least partially detached from the rotor hub, and move radially outward toward the outer case of the engine.

SUMMARY

One exemplary embodiment of this disclosure relates to a gas turbine engine including a blade outer air seal (BOAS) having at least one attachment hook adjacent one of a leading edge and a trailing edge thereof. The BOAS further includes at least one radial standoff axially aligned with the at least one attachment hook.

In a further embodiment of any of the foregoing, the BOAS includes first and second circumferential edges, the at least one radial standoff provided adjacent the first circumferential edge.

In a further embodiment of any of the foregoing, the radial standoff extends circumferentially beyond the first circumferential edge to radially overlap a second circumferential edge of an adjacent BOAS.

In a further embodiment of any of the foregoing, a slot is at least partially provided by the at least one radial standoff and the second circumferential edge of the adjacent BOAS.

In a further embodiment of any of the foregoing, the at least one radial standoff includes a first and second radial standoff, and wherein the at least one attachment hook includes a first attachment hook adjacent a leading edge of the BOAS and a second attachment hook adjacent a trailing edge of the BOAS.

In a further embodiment of any of the foregoing, the first radial standoff is axially aligned with the first attachment hook, and wherein the second radial standoff is axially aligned with the second attachment hook.

In a further embodiment of any of the foregoing, each of the first and second attachment hooks include a radial portion extending upwardly from a main body of the BOAS, the radial portion of the first attachment hook and a radial portion of the first radial standoff provided in a first plane, the radial portion of the second attachment hook and a radial portion of the second radial standoff provided in a second plane.

In a further embodiment of any of the foregoing, the at least one radial standoff extends substantially the same height above a main body of the BOAS as the at least one attachment hook.

In a further embodiment of any of the foregoing, an upper surface of the at least one radial standoff is in close proximity to an engine static structure.

Another exemplary embodiment of this disclosure relates to a blade outer air seal (BOAS). The BOAS includes at least one attachment hook, and at least one radial standoff axially aligned with the at least one attachment hook.

In a further embodiment of any of the foregoing, the at least one attachment hook extends substantially the same height above a main body of the BOAS as the at least one attachment hook.

In a further embodiment of any of the foregoing, the BOAS includes a leading edge, a trailing edge, and first and second circumferential edges, the at least one radial standoff protruding circumferentially beyond the first circumferential edge.

In a further embodiment of any of the foregoing, the at least one radial standoff includes a first and second radial standoff, and wherein the at least one attachment hook includes a first attachment hook adjacent a leading edge of the BOAS and a second attachment hook adjacent a trailing edge of the BOAS.

In a further embodiment of any of the foregoing, the first radial standoff is axially aligned with the first attachment hook, and wherein the second radial standoff is axially aligned with the second attachment hook.

In a further embodiment of any of the foregoing, each of the first and second attachment hooks include a radial portion extending upwardly from a main body of the BOAS, the radial portion of the first attachment hook and a radial portion of the first radial standoff provided in a first plane, the radial portion of the second attachment hook and a radial portion of the second radial standoff provided in a second plane.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

BRIEF DESCRIPTION OF THE DRAWINGS

The drawings can be briefly described as follows.

DETAILED DESCRIPTION

Figure 1:
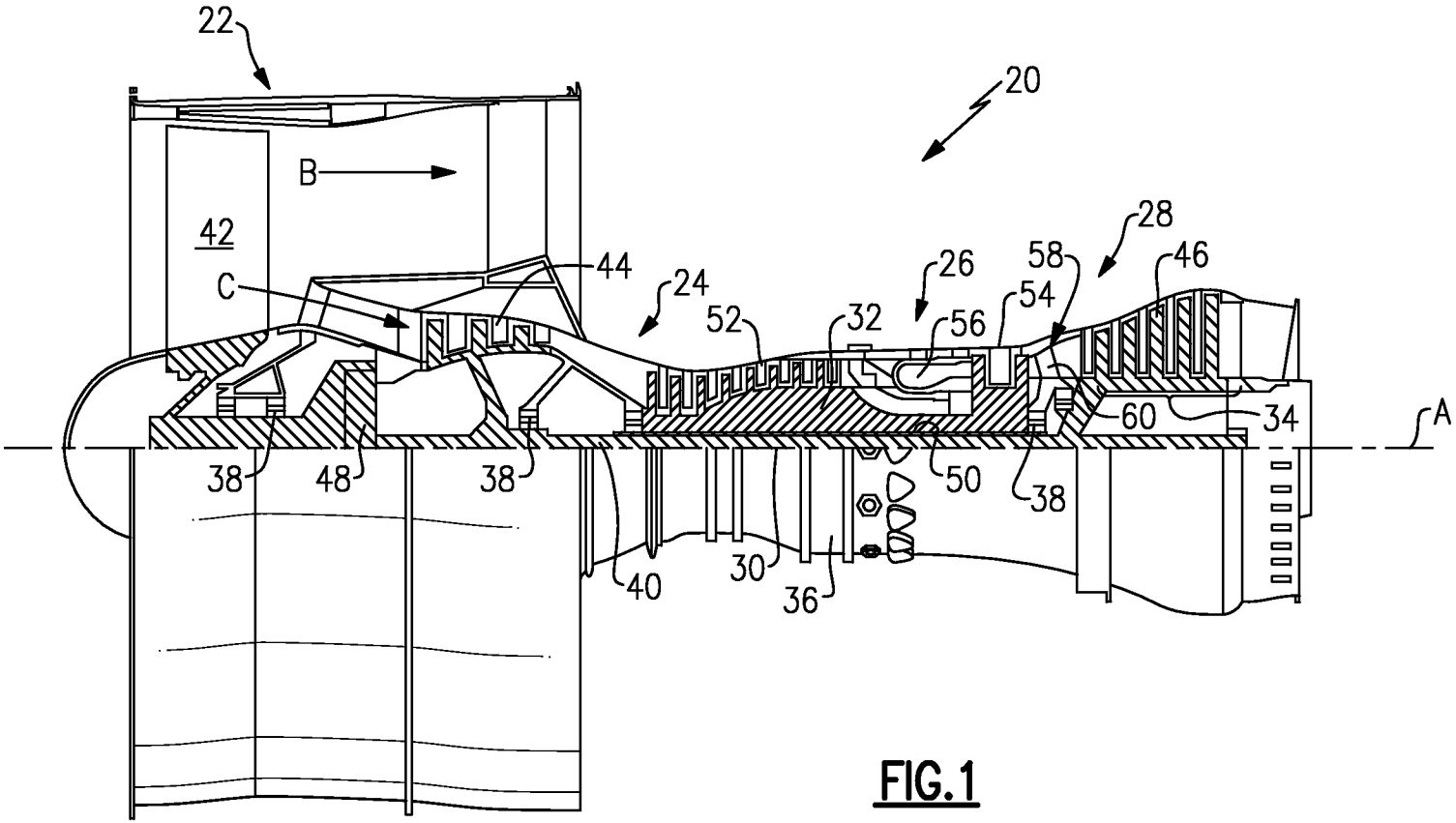
FIG. 1 illustrates a schematic, cross-sectional view of a gas turbine engine.

FIG. 1 schematically illustrates an example gas turbine engine 20 that includes a fan section 22, a compressor section 24, a combustor section 26, and a turbine section 28. Alternative engines might include an augmenter section (not shown) among other systems or features. The fan section 22 drives air along a bypass flow path B while the compressor section 24 draws air in along a core flow path C where air is compressed and communicated to a combustor section 26.

In the combustor section 26, air is mixed with fuel and ignited to generate a high pressure exhaust gas stream that expands through the turbine section 28 where energy is extracted and utilized to drive the fan section 22 and the compressor section 24.

Although the disclosed non-limiting embodiment depicts a turbofan gas turbine engine, it should be understood that the concepts described herein are not limited to use with turbofans as the teachings may be applied to other types of turbine engines; for example a turbine engine including a three-spool architecture in which three spools concentrically rotate about a common axis and where a low spool enables a low pressure turbine to drive a fan via a gearbox, an intermediate spool that enables an intermediate pressure turbine to drive a first compressor of the compressor section, and a high spool that enables a high pressure turbine to drive a high pressure compressor of the compressor section. The concepts disclosed herein can further be applied outside of gas turbine engines.

The example engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that connects a fan 42 and a low pressure (or first) compressor section 44 to a low pressure (or first) turbine section 46. The inner shaft 40 drives the fan 42 through a speed change device, such as a geared architecture 48, to drive the fan 42 at a lower speed than the low speed spool 30. The high speed spool 32 includes an outer shaft 50 that interconnects a high pressure (or second) compressor section 52 and a high pressure (or second) turbine section 54. The inner shaft 40 and the outer shaft 50 are concentric and rotate via the bearing systems 38 about the engine central longitudinal axis A.

A combustor 56 is arranged between the high pressure compressor 52 and the high pressure turbine 54. In one example, the high pressure turbine 54 includes at least two stages to provide a double stage high pressure turbine 54. In another example, the high pressure turbine 54 includes only a single stage. As used herein, a "high pressure" compressor or turbine experiences a higher pressure than a corresponding "low pressure" compressor or turbine.

The example low pressure turbine 46 has a pressure ratio that is greater than about five (5). The pressure ratio of the example low pressure turbine 46 is measured prior to an inlet of the low pressure turbine 46 as related to the pressure measured at the outlet of the low pressure turbine 46 prior to an exhaust nozzle.

A mid-turbine frame 58 of the engine static structure 36 is arranged generally between the high pressure turbine 54 and the low pressure turbine 46. The mid-turbine frame 58 further supports bearing systems 38 in the turbine section 28 as well as setting airflow entering the low pressure turbine 46.

The core airflow C is compressed by the low pressure compressor 44 then by the high pressure compressor 52 mixed with fuel and ignited in the combustor 56 to produce high speed exhaust gases that are then expanded through the high pressure turbine 54 and low pressure turbine 46. The mid-turbine frame 58 includes vanes 60, which are in the core airflow path and function as an inlet guide vane for the low pressure turbine 46. Utilizing the vane 60 of the mid-turbine frame 58 as the inlet guide vane for low pressure turbine 46 decreases the length of the low pressure turbine 46 without increasing the axial length of the mid-turbine frame 58. Reducing or eliminating the number of vanes in the low pressure turbine 46 shortens the axial length of the turbine section 28. Thus, the compactness of the gas turbine engine 20 is increased and a higher power density may be achieved.

The disclosed gas turbine engine 20 in one example is a high-bypass geared aircraft engine. In a further example, the gas turbine engine 20 includes a bypass ratio greater than about six (6), with an example embodiment being greater than about ten (10).

The example geared architecture 48 is an epicyclical gear train, such as a planetary gear system, star gear system or other known gear system, with a gear reduction ratio of greater than about 2.3.

In one disclosed embodiment, the gas turbine engine 20 includes a bypass ratio greater than about ten (10:1) and the fan diameter is significantly larger than an outer diameter of the low pressure compressor 44. It should be understood, however, that the above parameters are only exemplary of one embodiment of a gas turbine engine including a geared architecture and that the present disclosure is applicable to other gas turbine engines.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft., with the engine at its best fuel consumption—also known as "bucket cruise Thrust Specific Fuel Consumption ('TSFC')"—is the industry standard parameter of pound-mass (lbm) of fuel per hour being burned divided by pound-force (lbf) of thrust the engine produces at that minimum point.

"Low fan pressure ratio" is the pressure ratio across the fan blade alone, without a Fan Exit Guide Vane ("FEGV") system. The low fan pressure ratio as disclosed herein according to one non-limiting embodiment is less than about 1.50. In another non-limiting embodiment the low fan pressure ratio is less than about 1.45.

"Low corrected fan tip speed" is the actual fan tip speed in ft/sec divided by an industry standard temperature correction of $[(\text{Tram}^\circ\ \text{R})/(518.7^\circ\ \text{R})]^{0.5}$. The "Low corrected fan tip speed," as disclosed herein according to one non-limiting embodiment, is less than about 1150 ft/second.

Figure 2:
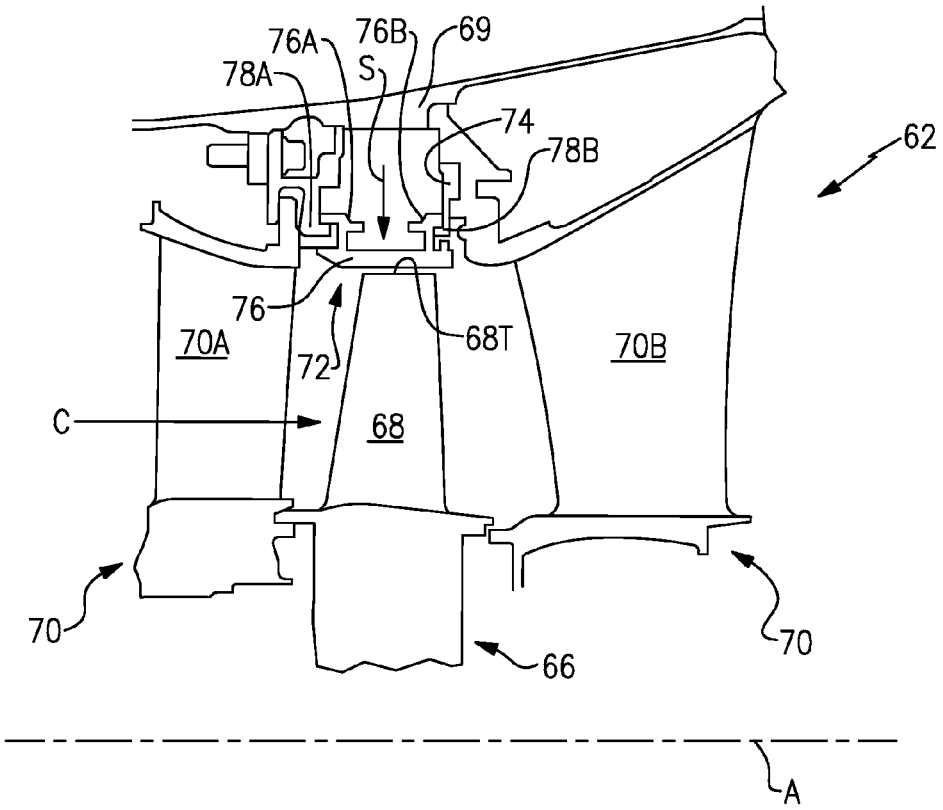
FIG. 2 illustrates a cross-section of a portion of a gas turbine engine.

FIG. 2 illustrates a portion 62 of a gas turbine engine, such as the gas turbine engine 20 of FIG. 1. In this exemplary embodiment, the portion 62 represents the high pressure turbine 54. However, it should be understood that other portions of the gas turbine engine 20 could benefit from the teachings of this disclosure, including but not limited to, the fan section 22, the compressor section 24 and the low pressure turbine 46.

In this exemplary embodiment, a rotor disk 66 (only one shown, although multiple disks could be axially disposed within the portion 62) is mounted for rotation about the engine central longitudinal axis A. The portion 62 includes alternating rows of rotating blades 68 (mounted to the rotor disk 66) and static vane assemblies 70. The vane assemblies 70 each includes a plurality of vanes 70A, 70B that are supported within an outer casing 69 of the engine static structure 36 (FIG. 1).

Each blade 68 of the rotor disk 66 includes a blade tip 68T at a radially outermost portion of the blade 68. The rotor disk 66 is arranged such that the blade tips 68T are located adjacent a blade outer air seal (BOAS) assembly 72. The BOAS assembly 72 may find beneficial use in many industries including aerospace, industrial, electricity generation, naval propulsion, pumps for gas and oil transmission, aircraft propulsion, vehicle engines and stationery power plants.

The BOAS assembly 72 is disposed in an annulus radially between the outer casing 69 and the blade tip 68T. The BOAS assembly 72 generally includes a support structure 74 and a multitude of BOAS segments 76 (only one shown in FIG. 2). For ease of reference, the individual BOAS segments 76 are each individually referred to as a "BOAS segment" or simply a "BOAS."

The BOAS segments 76 may be arranged to form a full ring hoop assembly that circumferentially surrounds the associated blades 68. The support structure 74 is mounted radially inward from the outer casing 69, and includes forward and aft flanges 78A, 78B that receive forward and aft attachment hooks 76A, 76B of the BOAS segments 76. The forward and aft flanges 78A, 78B may be manufactured of a material such as a steel or nickel-based alloy, and may be circumferentially segmented for the receipt of the BOAS segments 76.

A secondary cooling airflow S may be communicated to the BOAS segments 76. The secondary cooling airflow S can be sourced from the high pressure compressor 52 or any other portion of the gas turbine engine 20. In addition to cooling the BOAS segment 76, the secondary cooling airflow S provides a biasing force that biases the BOAS segment 76 radially inward toward the engine central longitudinal axis A. In one example, the forward and aft flanges 78A, 78B are portions of the support structure 74 that limit radially inward movement of the BOAS segment 76 and that maintain the BOAS segment 76 in position.

Figure 3:
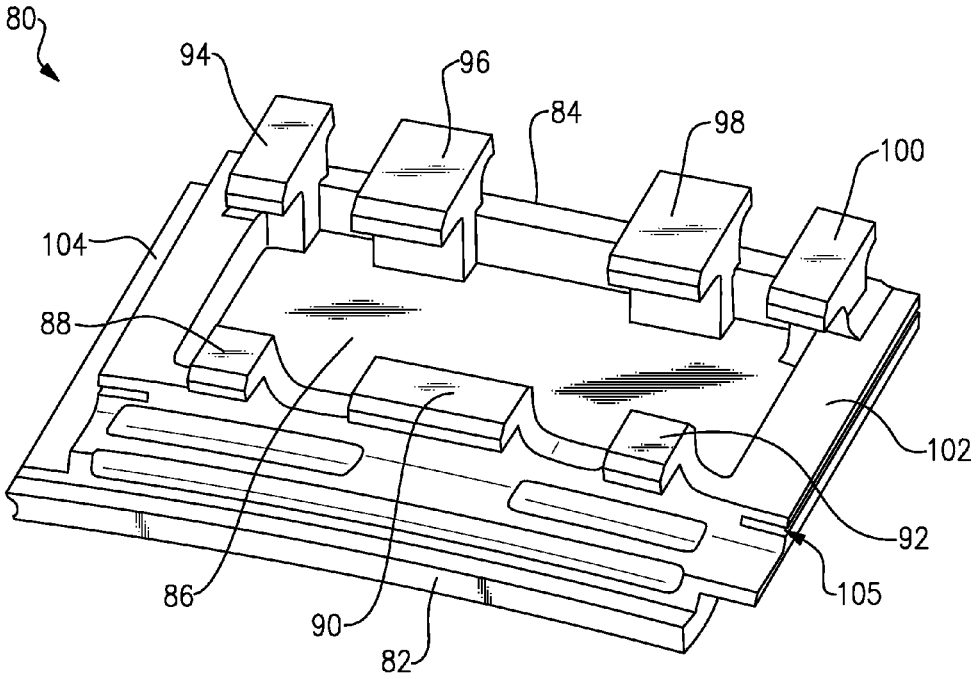
FIG.3 Prior Art
FIG. 3 illustrates a prior art BOAS.

FIG. 3 illustrates a perspective view of a prior art BOAS segment 80. The BOAS segment 80 includes a fore edge 82, an aft edge 84, and a main body portion 86 therebetween. In this example, three fore attachment hooks 88, 90, 92 extend upwardly from the main body portion 86 adjacent the fore edge 82, and four aft attachment hooks 94, 96, 98, 100 extend upwardly from the main body portion 86 adjacent the aft edge 84. The BOAS segment 80 further includes a circumferential flange 102 adjacent a circumferential edge thereof. The circumferential flange 102 corresponds to a slot 104 provided at another circumferential edge of an adjacent BOAS segment to provide a slot 105 (for a featherseal, for example) (FIG. 6B).

Figure 4:
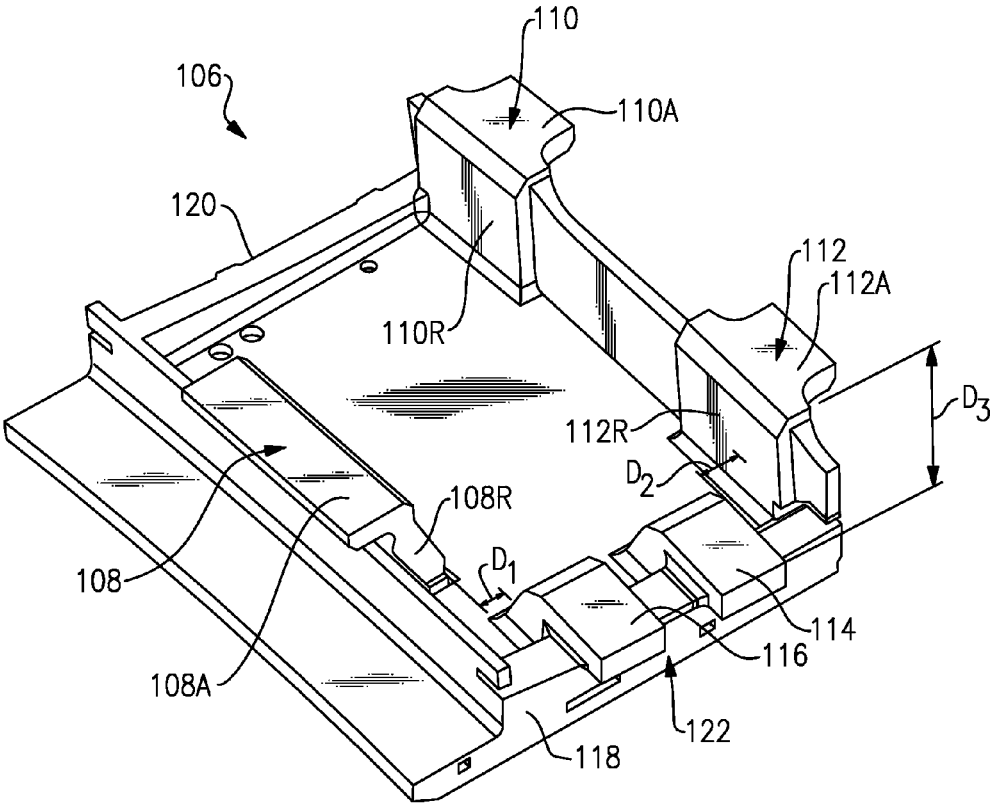
FIG.4 Prior Art
FIG. 4 illustrates another prior art BOAS.

FIG. 4 illustrates another prior art BOAS segment 106. This BOAS segment 106 includes a single fore attachment flange 108 and two aft attachment flanges 110, 112. The BOAS segment 106 further includes two flanges 114, 116 at one circumferential edge 118 thereof. The flanges 114, 116 extend circumferentially away from the circumferential edge 118, and are intended to overlap another circumferential edge 120 of an adjacent BOAS segment to form a slot 122 (for a featherseal, for example).

The attachment hooks 108, 110, 112 each include a radial portion 108R, 110R, 112R and an axial portion 108A, 110A, 112A. The flanges 114, 116 are spaced axially from the radial portions of the attachment hooks 108, 110, 112. For instance, the flange 116 is spaced a distance D1 from the radial portion 108R. Further, the flange 114 is spaced a distance D2 from the radial portions 110R and 112R. Further, an uppermost surface of the flanges 114, 116 is radially spaced a distance D3 from the axial surfaces 108A, 110A, 112A.

Figure 5:
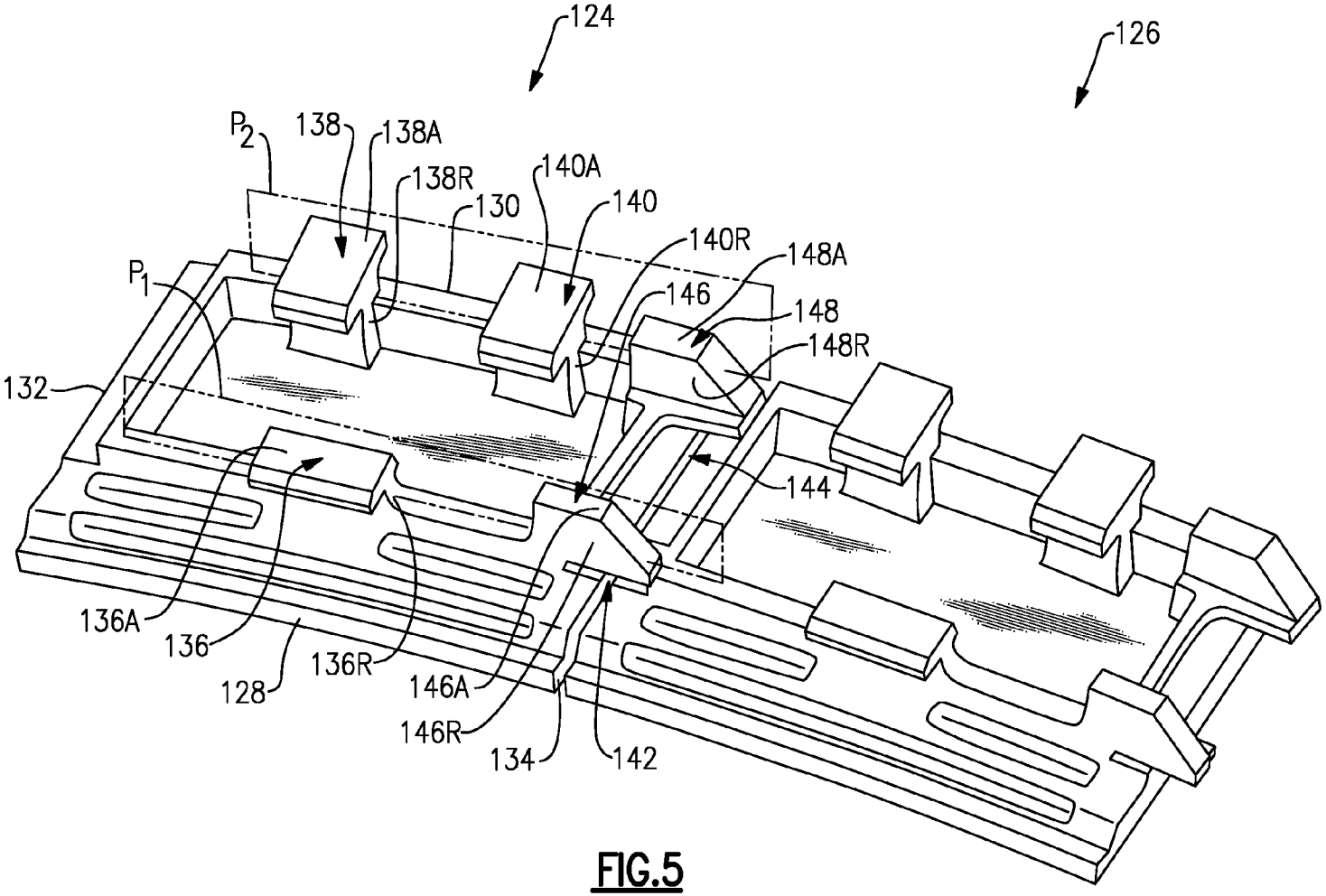
FIG. 5 illustrates an example BOAS assembly according to this disclosure.

FIG. 5 illustrates a BOAS assembly according to this disclosure including adjacent BOAS segments 124, 126. With reference to the BOAS segment 124, the BOAS segment 124 includes a fore edge 128, an aft edge 130, and circumferential edges 132, 134. The BOAS segment 124 includes a single fore attachment hook 136, and two aft attachment hooks 138, 140 extending upwardly from the main body portion 127 of the BOAS segment 124. When positioned adjacent a similar BOAS segment 126, the circumferential edges 132, 134 are configured to provide a featherseal slot 142 at an intersegment 144 between the BOAS segment 124 and the adjacent BOAS segment 126. The featherseal slot 142 in this example is further provided by a plurality of radial standoffs 146, 148.

The BOAS segment 124 further includes a plurality of radial standoffs 146, 148 provided adjacent one circumferential edge 134 of the BOAS segment 124. The radial standoffs 146, 148 extend circumferentially beyond the circumferential edge 134 and are intended to overlap the intersegment 144 between the BOAS segment 124 and the adjacent BOAS segment 126. The radial standoffs 146, 148 provide an outer boundary for the featherseal slot 142.

The radial standoffs 146, 148 each include a radial portion 146R, 148R terminating at an upper surface 146A, 148A. The radial portions 146R, 148R are axially aligned with the radial portions 136R, 138R, and 140R of the respective attachment hooks 136, 138, 140. For instance, the radial portion 146R fore radial standoff 146 is provided in the same radial plane P1 as the radial portion 136R of the fore attachment hook 136. Likewise, the radial portions 138R, 140R are provided in the same radial plane P2 as the radial portion 148R of the aft attachment hook 148. The radial planes P1, P2 are normal to the engine central longitudinal axis A, and thus points lying in the same radial plane are axially aligned. This axial alignment in the same radial plane provides the radial standoffs 146, 148 with increased rigidity.

Figure 6A:
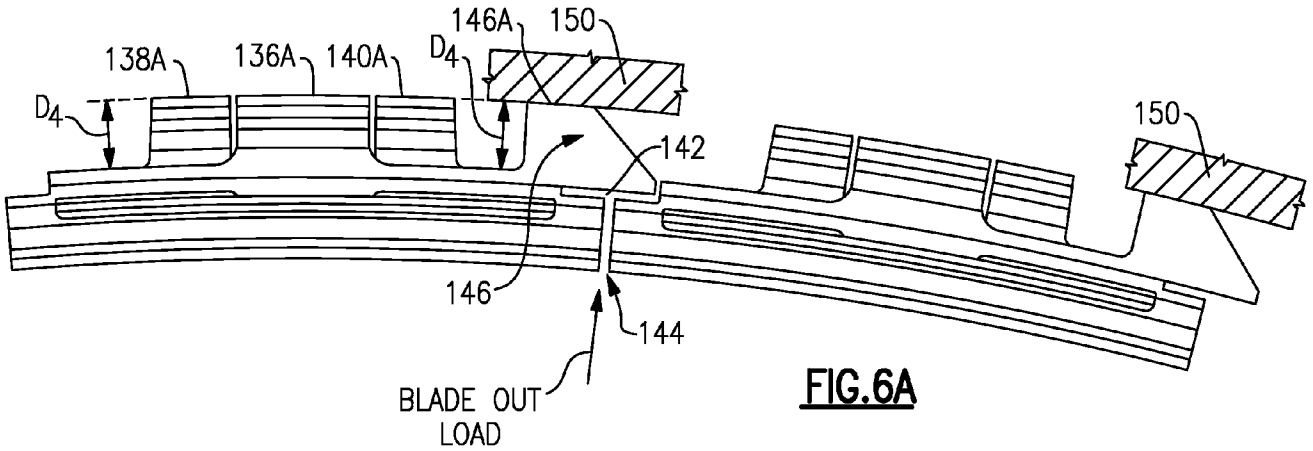
FIG. 6A is a front view of the BOAS assembly of FIG. 5.
Figure 6B:
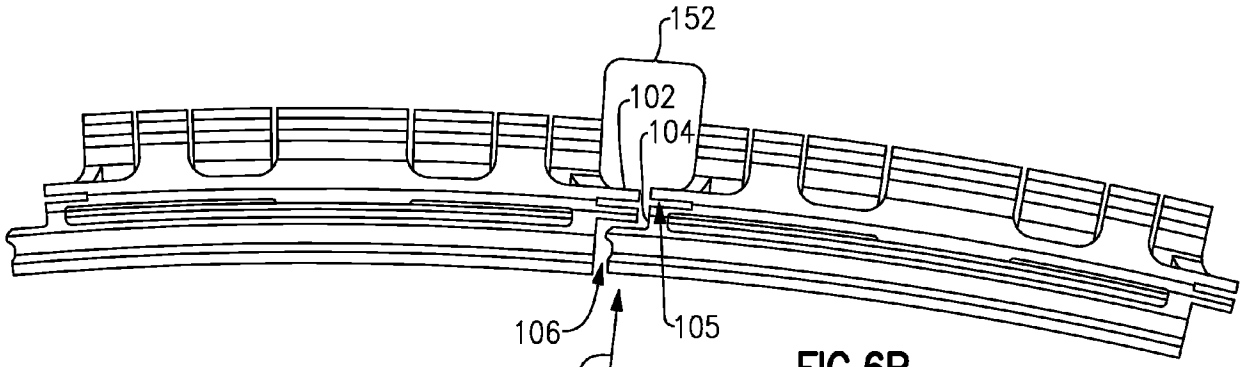
FIG.6B Prior Art
FIG. 6B is a front view of a prior art assembly including the BOAS of FIG. 3.

As perhaps best seen in FIG. 6A, the radial standoffs 146, 148 extend the same height D4 above a main body portion 127 of the BOAS 124 as the axial portions of the attachment hooks 136A, 138A, 140A. This allows the upper surfaces 146A, 148A of the radial standoffs 146, 148 to engage an engine static structure 150. Therefore, the radial standoffs 146, 148 can effectively absorb a load at the intersegment section 144 by transferring the load to the engine static structure 150. The engine static structure 150 is a portion of outer casing 69. In another example, the engine static structure 150 is a structure directly connected to the outer casing 69.

Whereas in the prior system, there is no support structure at the circumferential intersegment location illustrated at 152, this disclosure provides radial standoffs 146, 148 configured to transfer loads at the intersegment, such as loads created during a blade out condition. Thus, this disclosure provides enhanced containment capability at the BOAS intersegment locations.

Although the different examples have the specific components shown in the illustrations, embodiments of this disclosure are not limited to those particular combinations. It is possible to use some of the components or features from one of the examples in combination with features or components from another one of the examples.

One of ordinary skill in this art would understand that the above-described embodiments are exemplary and non-limiting. That is, modifications of this disclosure would come within the scope of the claims. Accordingly, the following claims should be studied to determine their true scope and content.

What is claimed is:

1. A gas turbine engine, comprising:

a blade outer air seal (BOAS) having at least one attachment hook adjacent one of a leading edge and a trailing edge thereof, and at least one radial standoff axially aligned with the at least one attachment hook, wherein the radial standoff extends circumferentially beyond a circumferential edge of the BOAS to provide a boundary of a featherseal slot.

2. The engine as recited in claim 1, wherein the BOAS includes first and second circumferential edges, the at least one radial standoff provided adjacent the first circumferential edge.

3. The engine as recited in claim 2, wherein the radial standoff radially overlaps a second circumferential edge of an adjacent BOAS.

4. The engine as recited in claim 2, wherein an outer boundary of the featherseal slot is provided by the at least one radial standoff and an inner boundary of the featherseal slot is provided by the adjacent BOAS.

5. The engine as recited in claim 1, wherein the at least one radial standoff includes a first and second radial standoff, and wherein the at least one attachment hook includes a first attachment hook adjacent a leading edge of the BOAS and a second attachment hook adjacent a trailing edge of the BOAS.

6. The engine as recited in claim 5, wherein the first radial standoff is axially aligned with the first attachment hook, and wherein the second radial standoff is axially aligned with the second attachment hook.

7. The engine as recited in claim 6, wherein each of the first and second attachment hooks include a radial portion extending upwardly from a main body of the BOAS, the radial portion of the first attachment hook and a radial portion of the first radial standoff provided in a first plane, the radial portion of the second attachment hook and a radial portion of the second radial standoff provided in a second plane.

8. The engine as recited in claim 1, wherein the at least one radial standoff extends substantially the same height above a main body of the BOAS as the at least one attachment hook.

9. The engine as recited in claim 8, wherein an upper surface of the at least one radial standoff engages an engine static structure.

10. A blade outer air seal (BOAS), comprising:

at least one attachment hook; and at least one radial standoff axially aligned with the at least one attachment hook, wherein the radial standoff extends circumferentially beyond a circumferential edge of the BOAS to provide a boundary of a featherseal slot.

11. The BOAS as recited in claim 10, wherein the at least one attachment hook extends substantially the same height above a main body of the BOAS as the at least one attachment hook.

12. The BOAS as recited in claim 10, wherein the at least one radial standoff includes a first and second radial standoff, and wherein the at least one attachment hook includes a first attachment hook adjacent a leading edge of the BOAS and a second attachment hook adjacent a trailing edge of the BOAS.

13. The BOAS as recited in claim 12, wherein the first radial standoff is axially aligned with the first attachment hook, and wherein the second radial standoff is axially aligned with the second attachment hook.

14. The BOAS as recited in claim 13, wherein each of the first and second attachment hooks include a radial portion extending upwardly from a main body of the BOAS, the radial portion of the first attachment hook and a radial portion of the first radial standoff provided in a first plane, the radial portion of the second attachment hook and a radial portion of the second radial standoff provided in a second plane.

* * * * *